United States Patent [19]

Nakasone

[11] 4,008,416

[45] * Feb. 15, 1977

[54] CIRCUIT FOR PRODUCING A GRADUAL CHANGE IN CONDUCTION ANGLE

[76] Inventor: Henry H. Nakasone, 1672 Camrose Way, Anaheim, Calif. 92802

[ * ] Notice: The portion of the term of this patent subsequent to Aug. 5, 1992, has been disclaimed.

[22] Filed: July 14, 1975

[21] Appl. No.: 595,585

Related U.S. Application Data

[63] Continuation-in-part of Ser. No. 364,693, May 29, 1973, Pat. No. 3,898,516.

[52] U.S. Cl. ..... 315/194; 307/252 N; 315/199; 315/DIG. 4; 323/19; 323/68

[51] Int. Cl.[2] ..... H05B 39/02

[58] Field of Search ..... 315/194, 199, 360, 102, 315/311, DIG. 4; 317/36 TD, 41; 323/19, 41, 68; 328/8; 307/252 B, 252 N, 252 T, 294

[56] References Cited

UNITED STATES PATENTS

| | | | |
|---|---|---|---|
| 3,389,328 | 6/1968 | Janson | 323/19 |
| 3,430,101 | 2/1969 | Biltz | 315/194 |
| 3,500,174 | 3/1970 | Ellerbeck | 323/41 X |
| 3,612,945 | 10/1971 | Stevens | 315/200 |
| 3,732,484 | 5/1973 | McKenna | 315/DIG. 4 |
| 3,896,369 | 7/1975 | Nakata | 307/252 N X |

*Primary Examiner*—Eugene La Roche

[57] ABSTRACT

The specification discloses a circuit which produces a gradual increase or decrease in the alternating current power applied to a series connected load. Double time constant gating circuitry and capacitor integration may be utilized in combination with self-heated thermistors to effect a gradual change in the conduction duration of a series connected control element.

7 Claims, 18 Drawing Figures

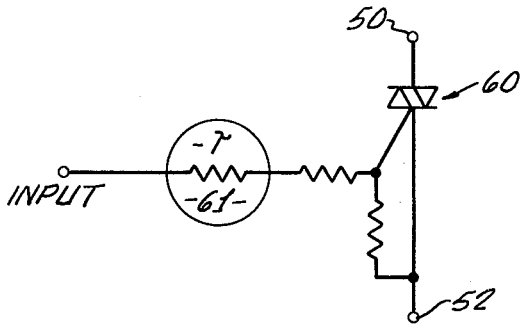
FIG. 1a.
(PRIOR ART)
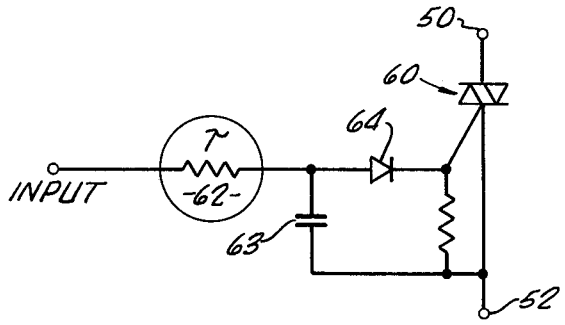
FIG. 1b.
(PRIOR ART)
FIG. 1c.
(PRIOR ART)
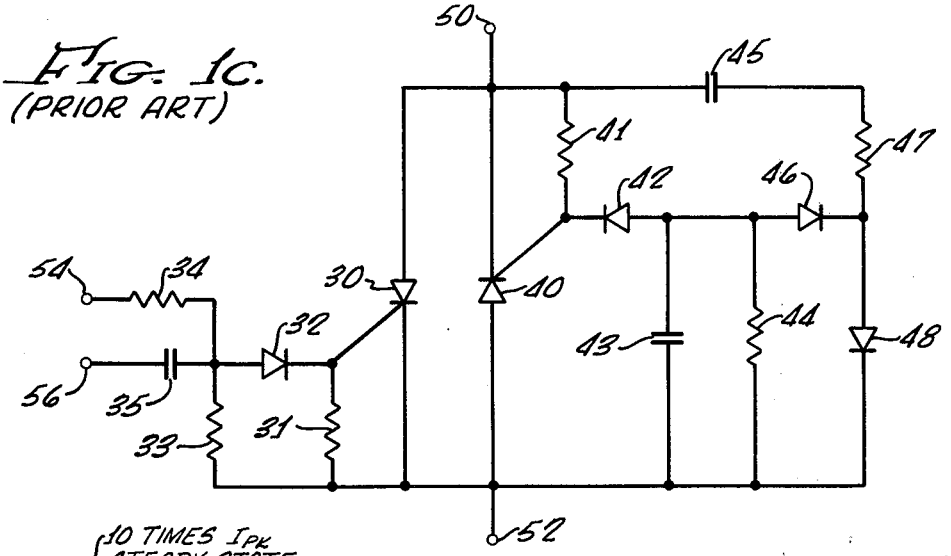
FIG 2a.
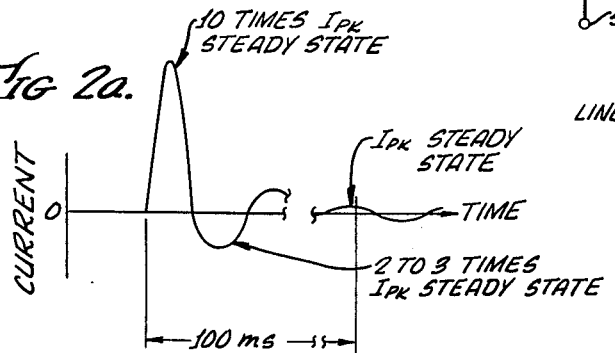
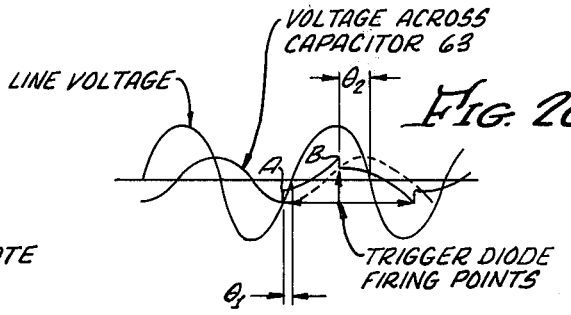
FIG. 2c.
FIG. 2b.
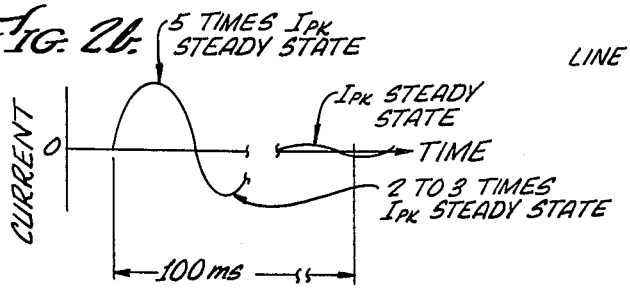
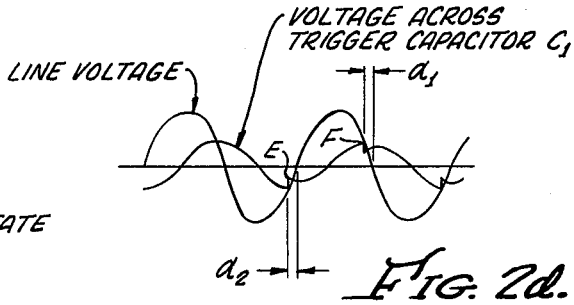
FIG. 2d.

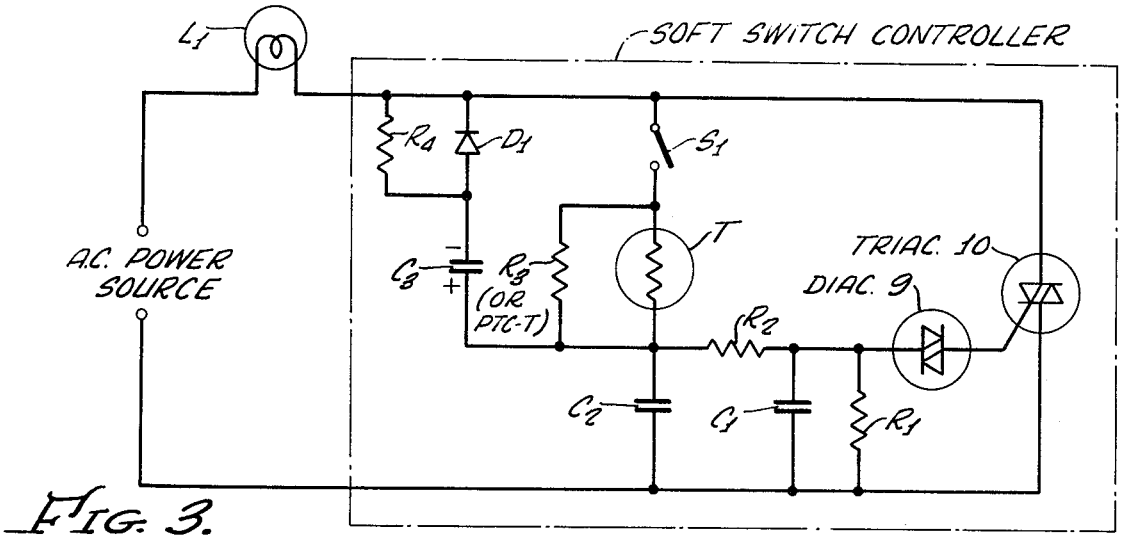
FIG. 3.
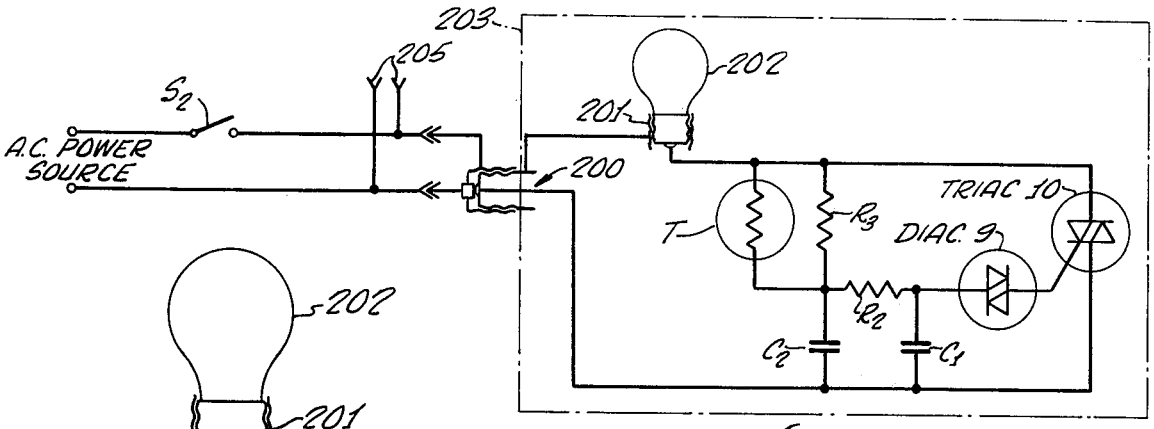
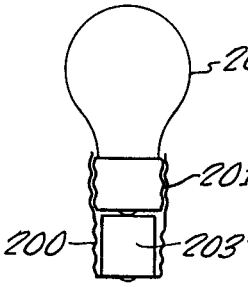
FIG. 4b.
FIG. 4a.
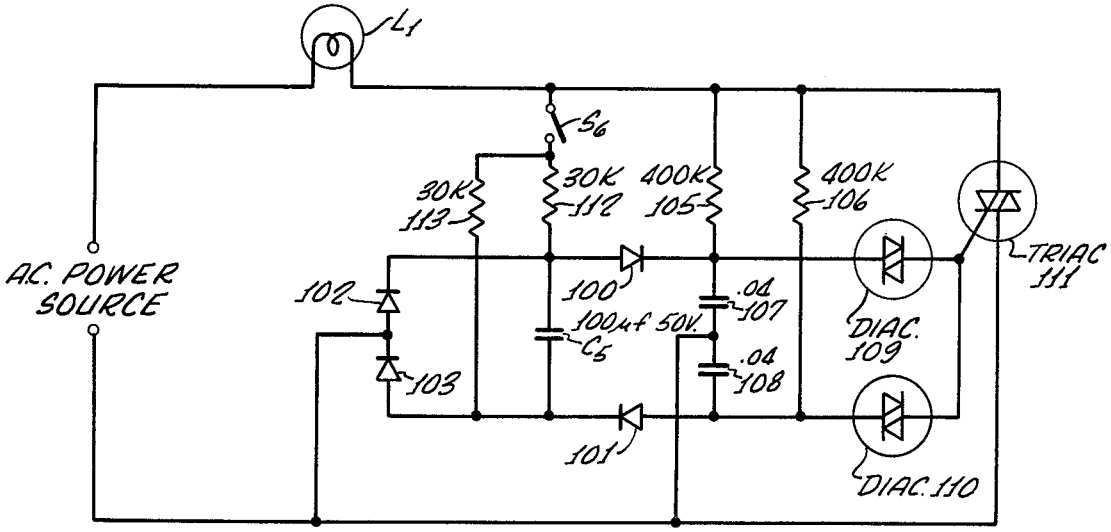
FIG. 5.

FIG. 8.
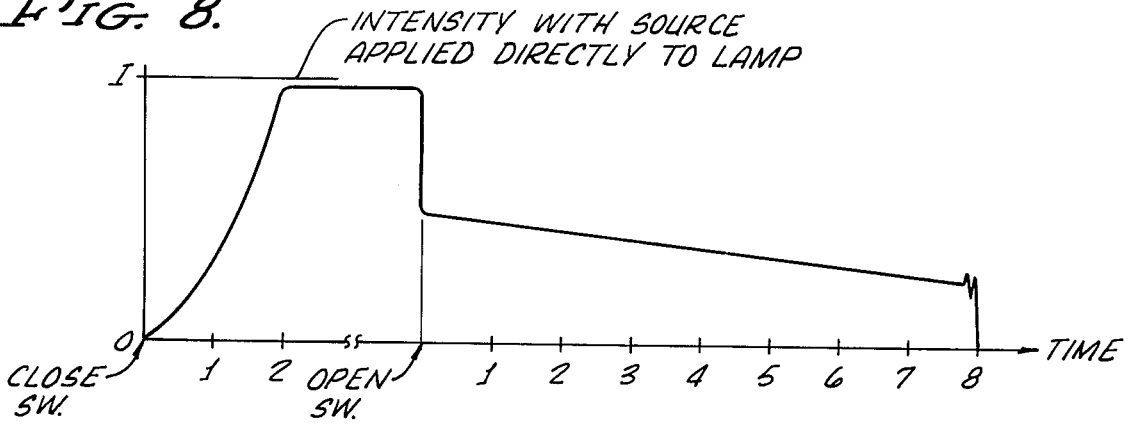
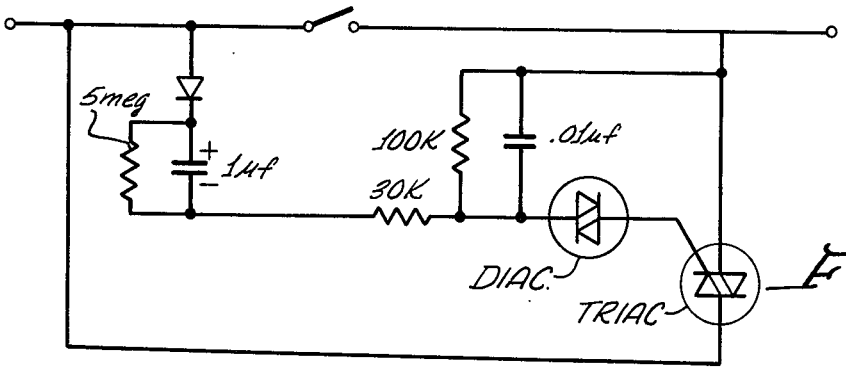
FIG. 9.
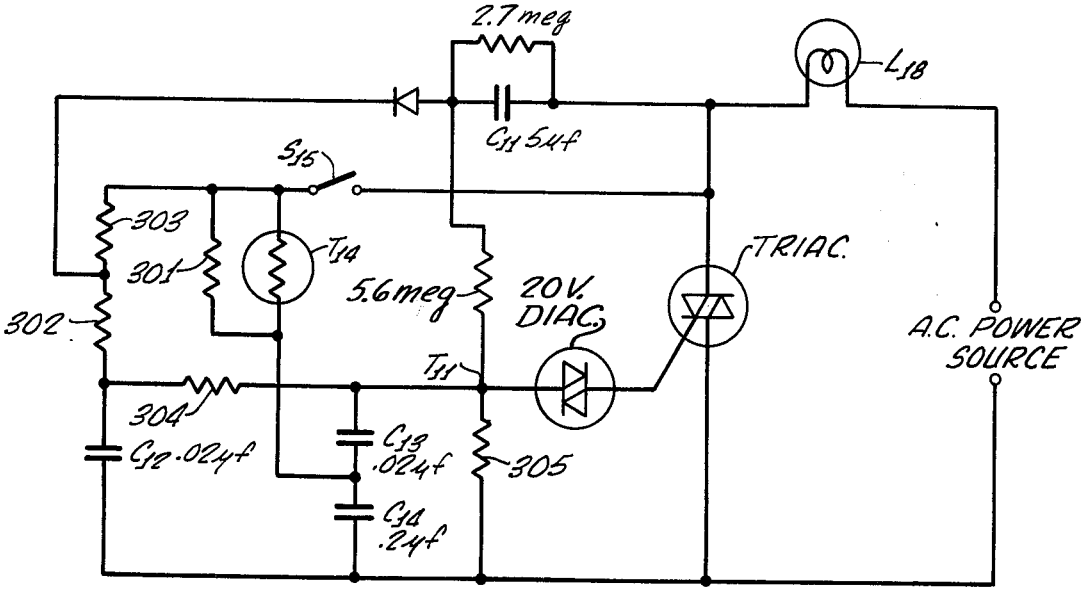
FIG. 10.

CIRCUIT FOR PRODUCING A GRADUAL CHANGE IN CONDUCTION ANGLE

BACKGROUND OF THE INVENTION

CROSS REFERENCES TO RELATED APPLICATIONS:

This is a Continuation-in-Part of an earlier application filed May 29, 1973, Ser. No. 364,693, by Henry H. Nakasone, now U.S. Pat. No. 3,898,516. The contents of that application are incorporated herein by reference.

DESCRIPTION OF THE PRIOR ART

Reference is made to U.S. Pat. No. 3,612,945 by Carlile R. Stevens issued Oct. 12, 1971 which utilized a thermistor to vary the light intensity from half brilliance to full brilliance. The present invention has as one of its objectives — to provide an improved circuit for gradually increasing the conduction angle from zero to nearly 360° using a self-heated thermistor in a configuration which precludes self-destruction of the thermistor. While circuits which effect similar results were shown and described in the parent application (Ser. No. 364,693) referred to herein above, it has been found that several important additional advantages may be achieved by combining the teachings of that application with the new matter disclosed herein. In particular if a self-heating thermistor is used, its resistance must be low enough to generate heat as the voltage across the thermistor decreases, but not so low as to impair "turn-off" reliability as a result of the increased thermistor dissipation due to the decay in lamp intensity. An additional problem presented by using a thermistor to achieve both slow "turn-on" and "turn-off" lies in the fact that the circuit will be extremely sensitive to ambient temperature changes and line voltage variations. These factors can cause turn-on delays or advance the start of the initial conduction period — thus impairing asthetic appeal and filament longevity. What is actually desired is a gradual "ON-OFF" controller which will perform consistently over a wide range of temperature and voltage variations.

Accordingly a primary object of this Continuation-in-Part is to provide an improved circuit for effecting a gradual "full" turn-on and a gradual "complete" turn-off of an incandescent lamp.

A further object of the improvement is to provide a soft switch controller employing a self-heating thermistor and a bistable switching element which can be series connected to gradually effect full turn-on of a lamp.

Another object of the present invention is to provide a light controller having a high steady state off impedance.

Another object of this Continuation-in-Part is to provide a circuit which will inherently reduce the potential across a self-heated thermistor as the resistance of the thermistor decreases, so as to cause the thermistor to be self-heated to a maximum temperature which does not exceed the rating of the thermistor.

Another object of this Continuation-in-Part is to provide a circuit for gradually applying power to a motor or other electromechanical device to provide smooth starts and stops.

A serious shortcoming of the prior art circuits shown in U.S. Pat. No. 3,612,945 lies in the fact that they do not reduce the instantaneous magnitude of the potential which is applied to the cold filament — even though those circuits may appear to effect a gradual increase in light intensity over some limited range. This shortcoming renders the prior art inoperative to accomplish one of its major objectives, namely that of applying power gradually so as to avoid damaging the light bulb. While this problem was solved by the parent application (Ser. No. 364,693), the importance of the invention in this regard was not fully delineated.

Accordingly, an additional object of the present improvement is to provide a means for gradually increasing the conduction angle from a small fraction of the A-C cycle to a large fraction of the A-C cycle.

In addition to the above advantages over the prior art, the present invention also includes embodiments which utilize capacitive charging (and various combinations thereof) to effect gradual turn-on and turn-off.

Other objects and advantages of the improvement will be obvious from the detailed description of a preferred embodiment given herein below.

SUMMARY OF THE INVENTION

The aforementioned objects are realized by a preferred embodiment of the present invention comprising a series connected controller which utilizes a double time constant integrator in combination with a self-heated thermistor - resistor network to gradually increase the conduction angle of a bistable switching element to effect a "soft" turn-on to full brillance. Soft turn-off (which may be characterized as a gradual decay following an abrupt initial drop) is achieved by a capacitor-diode network.

Other embodiments include capacitor-diode and photo-resistive turn-on circuits, in combination with separate polarity triggering to eliminate firing angle discontinuity.

DESCRIPTION OF THE DRAWINGS:

FIGS. 1*a*–1*c* show various prior art circuits as follows:

- FIG. 1*a* shows a thermistor connected directly to the gate of a triac.
- FIG. 1*b* shows a thermistor-capacitor-breakover diode for triggering a triac.
- FIG. 1*c* shows a circuit which conducts during one polarity of the input cycle, but which gradually increases the conduction cycle during each successive half cycle of the other polarity.

FIG. 2*a* shows the current waveform when an incandescent lamp is switched ON at the peak of the A-C cycle.

FIG. 2*b* shows the current waveform when an incandescent lamp is switched ON at the zero crossing point.

FIG. 2*c* shows the charging and discharge waveform of a single time constant capacitor-diac circuit.

FIG. 2*d* shows how triggering discontinuity is reduced by maintaining a voltage on the capacitor.

FIG. 3 shows the operative elements of a preferred embodiment of an improved soft switch controller.

FIG. 4*a* shows an alternative embodiment of the controller wherein only those components which are necessary to effect gradual turn-on utilized.

FIG. 4*b* shows a preferred embodiment of the adaptor for housing the turn-on components.

FIG. 5 shows an isolated polarity trigger circuit employing an R-C time constant to effect gradual turn-on and turn-off.

FIG. 8 shows a plot of the intensity as a function of time for a typical circuit like that shown in FIG. 3.

FIG. 9 shows a circuit which can be connected in parallel with any existing single pole, single throw switch to effect gradual turn-off.

FIG. 10 shows a preferred embodiment of a rapid recovery circuit for effecting gradual turn-on using a self-heated thermistor and gradual turn-off using a relatively small capacitor.

Figure 6:
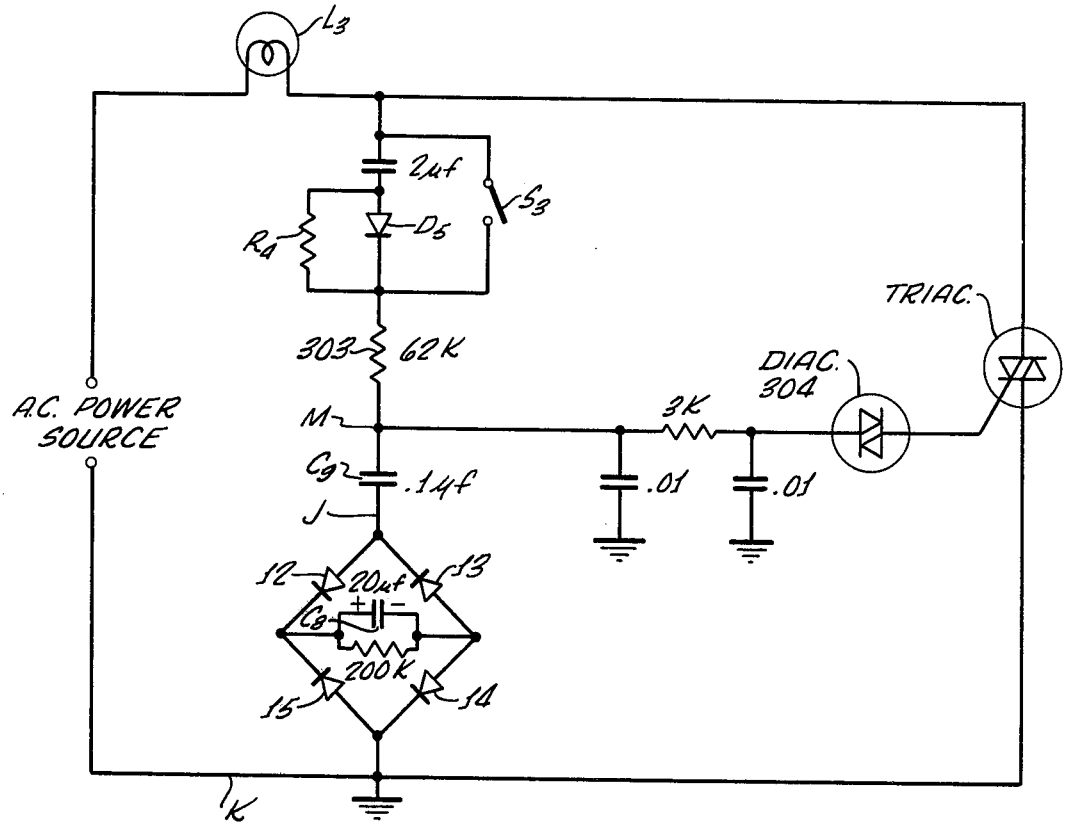
FIG. 6 shows an alternative embodiment of an R-C time constant circuit for effecting gradual turn-on and turn-off.

DETAILED DESCRIPTION OF A PREFERRED EMBODIMENT:

An appreciation of the present invention and its importance is best gleaned from an examination of the prior art shown in U.S. Pat. No. 3,612,945. Referring therefore to FIGS. 1*a*–1*c* (which are reproduced from said prior art patent), it will be seen that these circuits are incapable of performing the desirable objectives set forth above. In FIG. 1a for example, there is no possibility of firing the triac 60 near the end of the A-C cycle (as would be required for a gradual warm up of the lamp filament) since there are no phase shifting components to delay the gate voltage. In other words, as the resistance of the thermistor decreases, the gate voltage increases, but the first firing point must be earlier than the peak of the input since the gate voltage and input voltage are in phase (i.e., unless the gate voltage reaches the firing level of the triac on or before the peak amplitude of the input voltage; it cannot possibly reach a greater value after the input voltage has reached its peak.)

Consider next the circuit shown in FIG. 1*b*, and the associated waveforms shown in FIG. 2*c*. At first glance this circuit appears to effect a gradual filament warm-up since the phase shifting characteristic of capacitor 63 permits the firing of the triac 60 beyond the peak of the impressed line voltage resulting in a small initial conduction angle $\theta_1$. When the trigger diode 64 fires however, it discharges the capacitor (as indicated by point A) so that the breakover voltage of the trigger diode 64 is reached near the peak amplitude (point B) of the next half cycle. When this occurs, the instantaneous current flowing through the nearly cold filament[1] may exceed the rated operating current by a factor of 10. This result, which is depicted in FIG. 2a, is due to the fact that in tungsten filament lamps, the cold filament resistance is approximately 1/10 that of the hot filament resistance. Figure 2b, by comparison, shows that if switching takes place at the cross-over point (zero voltage) the peak inrush current is reduced by a factor of 2 (due to the heating of the filament during the ¼ cycle before the peak voltage is reached[2]).

[1] For a 100 watt bulb, the thermal time constant may be 20 millisec — so that very little heating will have taken place during the short interval $\theta_1$.

[2] Even this reduction in initial current has been shown to increase bulb life by approx. 10 times with a 90% confidence level.

It will thus be understood that the important condition to avoid in enhancing bulb life is that of applying a large voltage to the filament before its resistance has increased. It will also be evident that the circuit shown in FIG. 1c is equally deficient in this regard — in that conduction (across terminals 50 and 52) may occur immediately if the initial voltage applied to inputs 54 or 56 is of such a polarity as to cause the gating elements (34, 35, 32 and 31) to trigger SCR 30 — notwithstanding the fact that SCR 40 gradually increases its conduction angle during each successive cycle of the opposite polarity by virtue of elements 41, 42, 43, 44, 45, 46, 47 and 48.

The shortcomings of the aforementioned prior art circuits are obviated by the Soft Switch circuitry for effecting a gradual[3] turn-on shown in FIG. 3.

[3] The term gradual as used herein shall mean a continuous change (without observable discontinuity) in intensity which is perceptible to a human being for a period of at least 1 second.

This embodiment of the invention comprises an ON-OFF switch $S_1$ (typically a latching push button or rocker type wall switch), a self-heating thermistor T, and padding resistor $R_3$, a capacitor $C_2$, an isolation resistor $R_2$, a capacitor $C_1$, a gate loading resistor $R_1$, a diac 9, and a triac 10.[4]

[4] Triac is a trade name of the General Electric Company for a gate-controlled full wave A-C silicon switch designed to switch from a blocking state to a conducting state for either polarity of applied voltage with a positive or negative gate signal.

When switch $S_1$ is initially closed the parallel resistance of $R_3$ and thermistor T, will, in combination with $R_2$, $C_2$ and $C_1$, determine the time at which conduction first takes place. In the worst case, the time constant must be long enough to insure that — even if $S_1$ is closed when the source crosses zero, the voltage on capacitor $C_1$ will not reach a potential sufficient to trigger diac 9 until late in the first half cycle. On the other hand, the time constant should not be so long as to prevent conduction during the first half cycle following a zero voltage closure of $S_1$. In most instances, however, $S_1$ will be closed at some time other than zero crossing, so that there will not be sufficient time to charge $C_1$ to the breakover voltage of diac 9 during the first half cycle. Moreover, since the capacitor $C_1$ is left charged at the completion of each half cycle, there will be a time delay before it can be discharged and recharged to a sufficient potential of the opposite polarity. In the usual case, therefore, triac 10 will not conduct until thermistor T has heated to a point such that $C_1$ will charge to the break-over voltage of diac 9 during a half cycle. Thus, in order to avoid noticeable delays, the thermal time constant of thermistor T must be small.

FIG. 2*d* shows the situation where the resistance of the $R_3$ — T combination has decreased sufficiently to breakdown diac 9. Since the voltage across the capacitors $C_2$ and $C_1$ lags the input voltage by 90°, this point will occur near the end of the cycle as indicated by the point "E" thus causing triac 10 to conduct during the period $\alpha_1$. When diac 9 breaks down, it begins to discharge the capacitor $C_1$ just as the diac 64 discharged the capacitor 63. In the present case however, the capacitor $C_2$ continues to supply charge to $C_1$ through isolation resistor $R_2$ — thus partially restoring the voltage on $C_1$. As a consequence, the firing point F during the next half cycle is delayed so that the conduction angle $\alpha_2$ is not considerably greater than $\alpha_1$. As the thermistor T continues to heat, the conduction periods increase — the overall effect being a smooth and progressive increase in the conduction period from an initial duration $\alpha_1$.[5]

[5] The terms smoothly and progressively as used herein together shall be defined to mean a change in conduction angle which does not produce a noticeable jump or discontinuity in light intensity.

Resistor $R_3$ should be selected to have a value of approx. ⅛ that of the nominal room temperature resistance of T in order to swamp out thermistor tolerances and changes in ambient temperature. Lowering the value of $R_3$ slows the rate at which gradual turn-on occurs while decreasing the time required for initial conduction. $R_3$ can also be a positive temperature coefficient thermistor to compensate for ambient temperature changes. [It may also be connected between $S_1$ and $C_1$ to effect these same results. ]

The thermistor T must be chosen such that it will generate sufficient self heat to achieve full brightness.[6]

[6] In actuality, the lamp $L_1$ during the entire A-C cycle since the voltage on capacitor $C_1$ must reach the breakdown potential of diac 9 in order to fire triac 10.

On the other hand, as the thermistor heats, its resistance drops causing additional current to flow, and unless the current is limited the thermistor will continue to decrease in resistance allowing the current to increase until the thermistor is destroyed. In the present invention, the lamp $L_1$ is in series with the thermistor — advantage thus being taken of the fact that, as the thermistor resistance decreases, the conduction angle increases so that the voltage available to heat the thermistor decreases. In other words, the voltage drop across $L_1$ produces a negative feedback, (by reducing the voltage available to heat the thermistor). Thus, for a judicious thermistor-capacitor combination, the lamp intensity will increase gradually to full brilliance without exceeding the maximum temperature rating of the thermistor.

An important advantage of the present improvement lies in the apparatus required to achieve soft turn-off. In the circuits shown in the parent application, gradual turn-off was achieved by increasing the impedance in series with one or more thermistors which caused the conduction angle to decrease as the resistance of the thermistor increased. In such a configuration however, the resistance of the thermistor must be large enough to effect continued cooling as the voltage increases due to the decreased drop across the series lamp. The use of high value thermistors however, presents a problem since the voltage may not be sufficient to generate adequate self-heating to effect full turn-on.

The soft turn-off circuitry shown in FIG. 3 solves the problem by employing a diode-capacitor charging network ($D_1$ and $C_3$). This network is not dependent upon the turn-on components, and T therefore, can be freely chosen to achieve the desired turn-on characteristics. The resistance $R_4$ is utilized to discharge capacitor $C_3$ when the diode capacitor network is shunted by T and $R_3$ during the time $S_1$ is closed. This enables the diode $D_1$ and $C_3$ to effect soft turn-off as follows: Upon opening switch $S_1$, the shunt (thermistor T and resistor $R_3$) is removed — and the diode $D_1$ begins to charge capacitor $C_3$ during each negative cycle of the input. Since the initial voltage on capacitor $C_3$ is low, diac 9 will be triggered near the beginning of the negative half cycle. During the positive half cycle however, no current flows — so that the lamp intensity drops to ½ its full brightness thus indicating the start of the soft turn-off period. As the capacitor $C_3$ begins to charge, the conduction angle progressively decreases [i.e., as the voltage across $C_3$ increases, it back biases diode $D_1$ so that a larger negative voltage is necesary to effect current flow through $C_3$]. Eventually $C_3$ charges to the peak value of the A-C source (e.g., 160 volts) at which point the lamp $L_1$ extinguishes. To recapitulate, the opening of $S_1$ causes the light intensity to drop to ½ brilliance — and gradually diminish to approximately ¼ brilliance ($C_3$ fully charged) at which point the lamp $L_1$ extinguishes[7]. After extinguishment, the total circuit impedance is on the order of 1 Megohm.

The intensity-time relationship shown in FIG. 8 can be achieved using the following values for the FIG. 3 components:

[7] To reduce the slight flicker (due to the unidirection current flow which builds up the voltage on $C_1$ and $C_2$) prior to extinguishment, a gate loading resistor $R_1$ can be used to discharge capacitor $C_1$.

| | | |
|---|---|---|
| $R_1 = 400K$ | | $C_1 = 0.1\ \mu f$ |
| $R_2 = 3.3K$ | | $C_2 = 0.1\ \mu f$ |
| $R_3 = 39K$ | (or PTC thermistor)[8] | $C_3 = 10\ \mu f$ 200 volts |
| $R_4 = 750K$ | | T = 300K - bead[8] (Gutton 53CA or equivalent) |

[8] The use of a 36K thermistor having a positive temperature coefficient of + 0.7%/° C in parallel with a 400K thermistor having a negative temperature coefficient of − 4.6%/° C provides almost perfect compensation for ambient temperature excursions of ± 20° C.

[9] $C_5$ is termed an accumulating capacitor since its voltage increases incrementally with each cycle of the A-C input.

It will be understood that the diac 9 may be incorporated in the same case as the triac 10 as contemplated in the parent application [eg., RCA 40431]or they may be separate components as illustrated in FIG. 3.

An alternative embodiment of the invention is shown in FIGS. 4*a* and 4*b*. In this embodiment, the control elements $C_1$, $C_2$, $R_2$, $R_3$, Triac 10 and diac 9 are housed within a separate fixture 203 which is adapted to screw into a conventional light socket 200. The fixture also has a female outlet 201 for connecting the lamp 202. Upon closure of $S_2$, the light intensity gradually increases; upon opening $S_2$, the light extinguishes abruptly. An advantage of this arrangement lies in the fact that the wall switch may also control other outlets (eg., 205) which from time-to-time might be used to operate devices other than incandescent lamps (eg., vacuum cleaners, shavers, hair dryers and so forth) which, if gradually turned-on might draw excessive starting currents that would overheat triac 10.

FIG. 5 shows a capacitive charging circuit which can be used to effect gradual turn-on as well as gradual turn-off. Prior to closure of $S_6$, the voltage across accumulating capacitor $C_5$ will be zero[9] — and the voltage produced by resistors 105 and 106 will not generate a sufficient amplitude across capacitors 107 and 108 to break down associated diacs 109 and 110. When $S_6$ is closed, $C_5$ begins to charge through resistors 112 – 113 and diodes 102 – 103. . The average voltage on capacitor 107 is thus shifter positively (through diode 100) and the average voltage on capacitor 108 is shifted negatively through diode 101. As a consequence, diac 109 begins to fire near the end of the positive half cycles and diac 110 begins to fire near the end of the negtive half cycles – the conduction angles of each gradually increasing as the capacitor $C_5$ continues to charge — triggering discontinuity being eliminated by the fact that separate capacitors 107 and 108 are used for positive and negative triggering respectively.

[9] $C_5$ is termed an accumulating capacitor since its voltage increases incrementally with each cycle of the A-C input.

Gradual turn-off is effected by opening $S_6$ — which results in a slight drop in the bulb intensity — followed by a gradual diminition as $C_5$ discharges through resistors 112 and 113. The circuit thus utilizes the same components to effect gradual turn-on and turn-off. It suffers a disadvantage in that the off state impedance is lower than the circuit shown in FIG. 3. Resistors 112 and 113 also limit the maximum brightness attainable, although this shortcoming can be obviated by additional diodes and switch contacts.

FIG. 6 shows another soft switch controller employing diode capacitor turn-on and a diode-capacitor turn-off. Prior to closure of $S_3$, the voltage across the accumulating capacitor $C_8$ is zero so that the impedance across the bridge (point J to the K side of the A-C source) is low. When $S_3$ is closed therefore, the integrating time constant is thus determined by resistor 303, and $C_9$. As $C_8$ charges through diodes 12, 13, 14 and 15, the impedance from point J to K changes [it is extremely high until the voltage at point J exceeds the voltage to which $C_8$ has charged — at which point the impedance abruptly drops to a very low value — effectively clamping point J during the remainder of the half cycle]. As a consequence, the voltage at point J follows the input voltage on line M until the voltage at J reaches the voltage $C_8$; thereafter $C_9$ charges at a rate determined by the value of $C_9$ and resistor 303. When the voltage of $C_8$ plus the voltage of $C_9$ reaches the breakover potential of diac 304, conduction occurs. As the voltage on $C_8$ builds up with each half cycle, the conduction angle increases (i.e., the time required each half cycle to charge $C_9$ to breakover diac 304 is decreased since the starting voltage at point J increases). In the absence of the 200K discharging resistor, the circuit will achieve nearly full turn-on of lamp $L_3$. As previously mentioned in connection with the circuit shown in FIG. 5, extra contacts on the ON-OFF switch ($S_3$) can be used to facilitate discharge in lieu of the 200K discharge resistor.

Turn-off of the circuit shown in FIG. 6 is identical to that previously described — except that the relatively high impedance offered by the fully charged capacitor $C_8$ does not require that $C_{10}$ be as large as $C_3$ to effect a comparable turn-off period.

Figure 7:
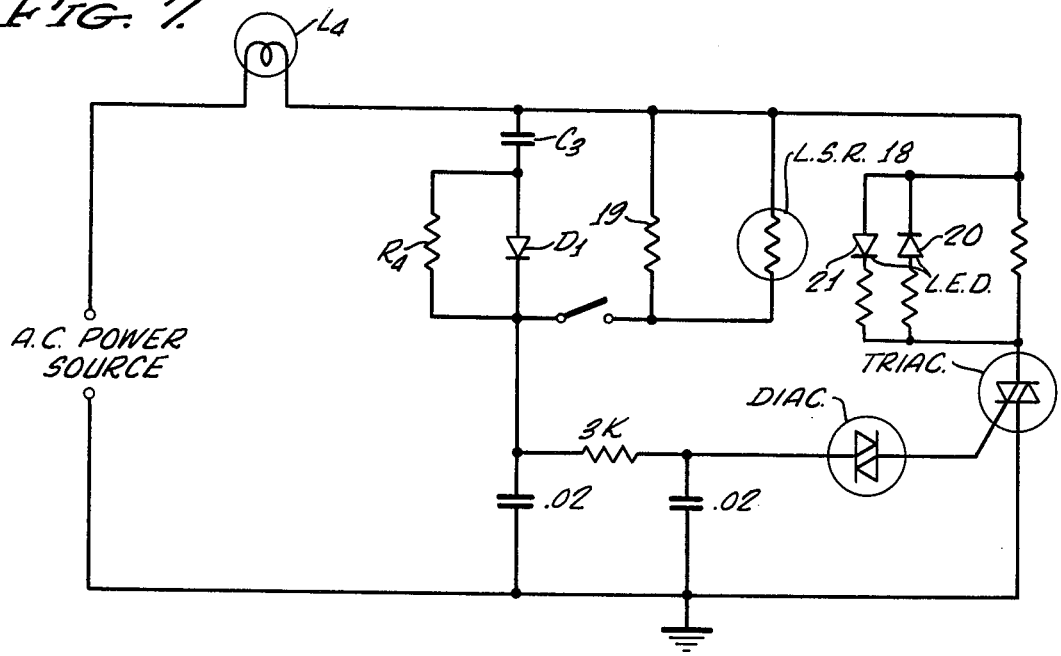
FIG. 7 shows a controller employing a photo-sensitive resistor and light source to change the conduction angle.

FIG. 7 shows another embodiment of a Soft Switch Controlleer which utilizes a light sensitive resistor 18 in parallel with a resistor 19. In the circuit shown, a pair of light emitting diodes 20 and 21 are utilized to provide the stimulus for decreasing the resistance of element 18. Careful selection and spacing of components is required to achieve the desired results. The circuit shown in FIG. 7 has a disadvantage in that power is dissipated in the main circuit — although the possibility of using the light from $L_4$ (or an auxilliary circuit) does exist.

FIG. 9 shows a circuit for providing gradual turn-off only. In this embodiment, the delay is determined by the 1Mf capacitor, which can be much smaller then the capacitor $C_3$ which serves a similar function in the circuit shown in FIG. 3. This because the gate impedance (the $0.01\mu f$ in parallel with the 100K resistor $R_{99}$) is much less than that required to self-heat a thermistor in order to effect gradual turn-on. The circuit of course, may utilize an SCR in place of triac 10 since conduction only occurs during the positive half cycle.

FIG. 10 shows a preferred circuit for achieving gradual turn-on and turn-off of series connected lamp $L_{18}$. In this embodiment, heating of the thermistor $T_{14}$ is effected via the $0.2\mu f$ capacitor $C_{14}$, whereas the impedance which appears at the terminal $T_{11}$ is approximately that of a $0.4\mu f$ capacitor ($C_{12}$ and $C_{13}$ in parallel). The circuit provides approximately ten seconds of delay (following a seven second closure of $S_{15}$) with a $5\mu f$ capacitor ($C_{11}$). This delay is sufficient to allow the thermistor $T_{14}$ to cool to a point such that $S_{15}$ can be reclosed (to effect gradual turn-on) as soon as the lamp $L_{18}$ extinguishes. Resistors 301, 302 and 303 should be selected to provide an instantaneous threshold illumination at the lowest line voltage at which the circuit must operate. $R_{305}$ should be selected to assure total turn-off at the highest line voltage at which the circuit is expected to operate. $R_{304}$ prevents instantaneous discharge of $C_{12}$ when the diac breaks down.

Figure 12:
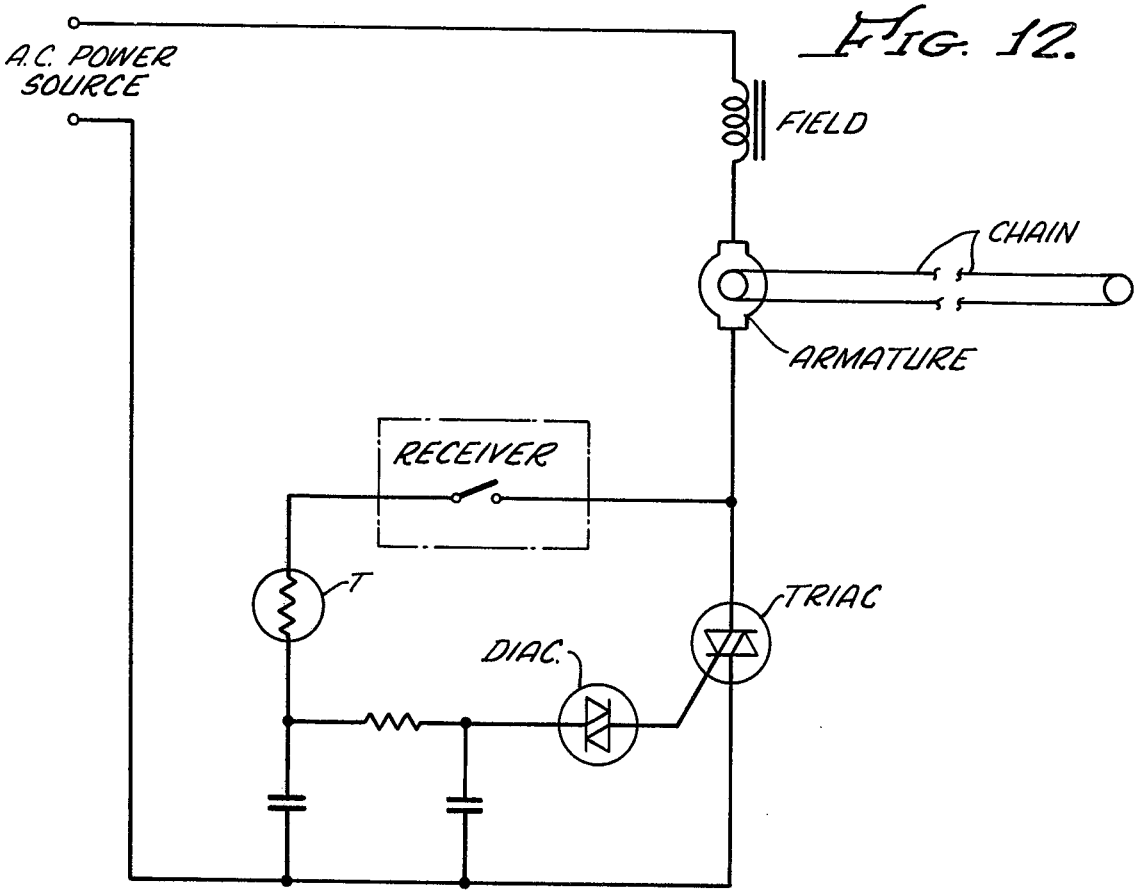
FIG. 12 shows a circuit for operating an electromechanical device to obtain gradual acceleration and deceleration.

FIG. 12 shows an application of the basic concept to gradually accelerate a load. The load may be any mass (for example a garage door) which is coupled to the output shaft of the prime mover (eg. a universal motor) so as to move in conjunction therewith. The field of the universal motor (so named because it will operate directly from either AC or DC power sources) is connected in series with the armature. The initial current (and hence the starting torque) in a universal motor is large since there is no rotation to generate a counter emf in the armature windings. As a consequence, the load will be subjected to a high initial acceleration. The circuit shown in FIG. 12 obviates this condition by gradually increasing the torque as the load comes "up-to-speed." A similar improvement can also be achieved by using the soft shut-off circuit previously described to decrease the speed of the load before stopping the motor completely.

Figure 11:
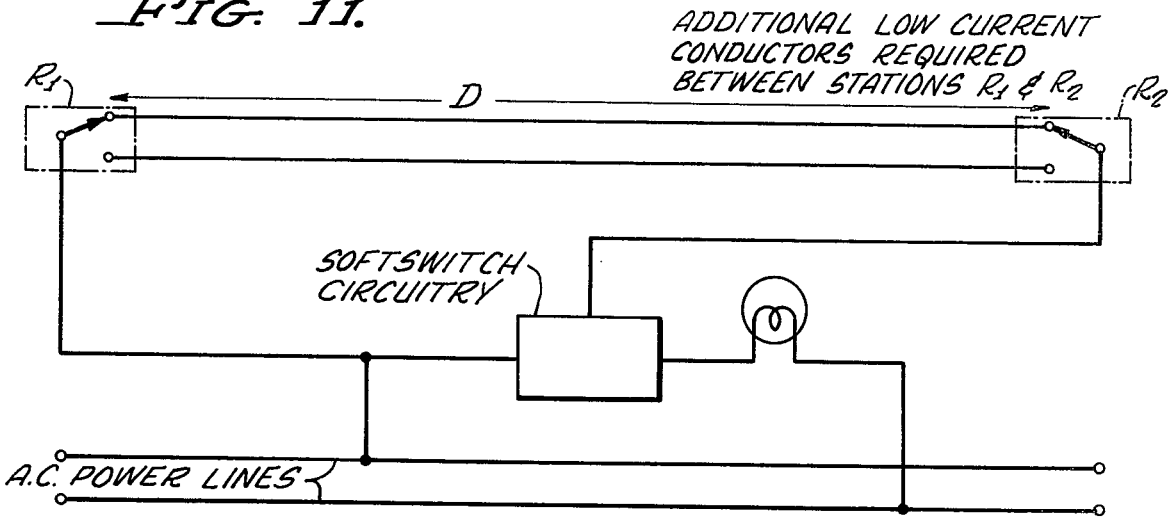
FIG. 11 shows the wiring arrangement for three-way operation.

FIG. 11 shows the wiring arrangement for utilizing the invention when the light is to be operated from two stations $R_1$ and $R_2$ which are separated by a distance D. In new homes, the additional wires may be installed at the time the home is built. In all other cases, new wires must be added if both slow turn-on and turn-off are desired. For gradual turn-on only however, the existing wiring may be used.

Although the improvements have been shown and described as complete circuits, it will be understood that the features may be used in various combinations with each other and with the circuits shown in the parent application. It will also be understood that the values and configurations are exemplary only, and that numerous changes, modifications and substitutions may be made without departing from the spirit of the invention.

I claim:

1. A soft switch comprising:

a solid state switching device having gate terminal means for altering the impedance between a paid of main terminals from a high impedance state to a low impedance state;

means for connecting said solid state switching device in series with a load and an A-C power source;

a switch having an ON position and an OFF position said switching having one terminal operatively connected to the junction connecting the load with said solid state switch device;

means operatively connected to said switch and the gate terminal of said solid state switching device for actuating said solid state switching device so as to cause said solid state switching device to delay conduction beyond the peak of the first complete A-C half cycle following the closure of said switch to the ON position, and for causing said solid state switching device to smoothly and progressively increase its conduction duration with each half cycle of the A-C source following the initial conduction.

2. The apparatus recited in claim 1 wherein said means for causing said solid state switching device to smoothly and progressively increase its conduction duration comprises:

a self-heated thermistor;

means for connecting a first terminal of said thermistor to one side of said load so as to reduce the voltage applied to said first terminal in accordance with the drop across said load.

3. The apparatus recited in claim 2 wherein said means for connecting said first terminal of said thermistor to one side of said load comprises said ON-OFF switch.

4. The apparatus recited in claim 3 wherein said means for causing said solid state switching device to delay conduction beyond the peak of the first complete half cycle and for smoothly and progressively increasing the conduction duration of said solid state switching device further includes:

a first capacitor having a first terminal connected to a second terminal of said thermistor;

a second capacitor;

an isolation resistor having one terminal connected to said first terminal of said first capacitor and a second terminal connected to a first terminal of said second capacitor;

means for connecting the second terminal of said first capacitor and the second terminal of said second capacitor to one side of the A-C source; and a trigger device;

means for connecting said trigger device to said gate terminal means and the first terminal of said second capacitor so as to cause the impedance between the main terminals of said solid state switching device to change from a high value to a low value when the voltage across said second capacitor reaches a predetermined value.

5. The apparatus recited in claim 4 including:

a padding resistor;

means for connecting said padding resistor to provide a parallel path with respect to said thermistor.

6. The appartus recited in claim 1 wherein said means for actuating said solid state switching device so as to cause said solid state switching device to delay conduction beyond the peak of the first complete A-C half cycle, and for smoothly and progressively increasing conduction duration comprises:

an accumulating capacitor;

rectifying means for progressively increasing the charge on said accumulating capacitor during each half cycle of the A-C source;

capacitor integrating means resistively connected to the A-C source and said gate terminal, for shifting the phase of the signal applied to said gate terminal with respect to the A-C source so as to delay the firing of said solid state switching device and;

means for connecting said accumulating capacitor and said capacitor integrating means so as to combine the voltage on said accumulating capacitor with the voltage of said capacitor integrating means so as to effect a gradual increase in the conduction angle of said solid state switching device to greater than 50% of the A-C source as the voltage on said accumulating capacitor increases.

7.

A gradual turn-off circuit for use with an A-C voltage source comprising:

a variable impedance device having a control terminal for changing the impedance of said variable impedance device;

a first capacitor;

at least one rectifier connected in series with said first capacitor;

means for connecting said first capacitor-rectifier combination to the A-C voltage source and to said control terminal whereby said variable impedance device will be caused to change its impedance when the instantaneous magnitude of the voltage source exceeds the voltage on said first capacitor; and further including;

a switch having a closed position and an open position;

a self-heated thermistor;

a second capacitor;

means for connecting said self-heated thermistor in series with said second capacitor and said switch so as to cause said thermistor and said second capacitor to be in parallel with said variable impedance device when said switch is in the closed position;

means for connecting the junction between said thermistor and said second capacitor to the control terminal of said variable impedance device.

* * * * *